United States Patent [19]

Azzaline et al.

[11] Patent Number: 4,747,287

[45] Date of Patent: May 31, 1988

[54] INCLINED AXES SPIN FLANGING HEAD AND METHOD FOR USING SAME

[75] Inventors: Paul H. Azzaline, Crystal Lake, Ill.; Henry J. Etling, Scotch Plains, N.J.

[73] Assignee: American National Can Company, Chicago, Ill.

[21] Appl. No.: 908,579

[22] Filed: Sep. 18, 1986

Related U.S. Application Data

[63] Continuation-in-part of Ser. No. 231,841, Feb. 5, 1981, abandoned.

[51] Int. Cl.[4] ..... B21D 19/12

[52] U.S. Cl. ..... 72/125; 72/126

[58] Field of Search ..... 72/94, 112, 119, 118, 72/115, 117, 126, 370, 454, 125

[56] References Cited

U.S. PATENT DOCUMENTS

| | | | |
|---|---|---|---|
| 545,791 | 9/1895 | Gates | 72/115 |
| 682,726 | 9/1901 | Lovekin | 72/119 |
| 941,190 | 11/1909 | Didier | 72/119 |
| 1,978,430 | 10/1934 | Kipnis | 72/119 |
| 1,983,407 | 12/1934 | Scholtes | 72/118 |
| 3,266,451 | 8/1966 | Kraus | 72/117 |
| 3,418,837 | 12/1968 | Vanderlaan et al. | 72/94 |
| 3,469,428 | 9/1969 | Aschberger | 72/94 |
| 3,498,245 | 3/1970 | Hansson | 72/126 |
| 4,018,176 | 4/1977 | Gnyp et al. | 72/94 |
| 4,435,969 | 3/1984 | Nichols et al. | 72/126 |

FOREIGN PATENT DOCUMENTS

| | | | |
|---|---|---|---|
| 374913 | 5/1923 | Fed. Rep. of Germany | 72/126 |
| 416539 | 7/1925 | Fed. Rep. of Germany | 72/115 |
| 163029 | 9/1984 | Japan | 72/126 |
| 182095 | 5/1966 | U.S.S.R. | 72/84 |

OTHER PUBLICATIONS

*Tooling & Production*, Oct. 1978, "Flanging QC Sharpens Metalforming Methods", pp. 64–66, by L. L. Lewis et al.

*Primary Examiner*—Lowell A. Larson
*Attorney, Agent, or Firm*—Ira S. Dorman

[57] ABSTRACT

A new type of inclined axes roller spin flanging tool for drawn and ironed containers is shown. The tool has a pilot, a specially configured roller and a predetermined cam rate for its use.

9 Claims, 2 Drawing Sheets

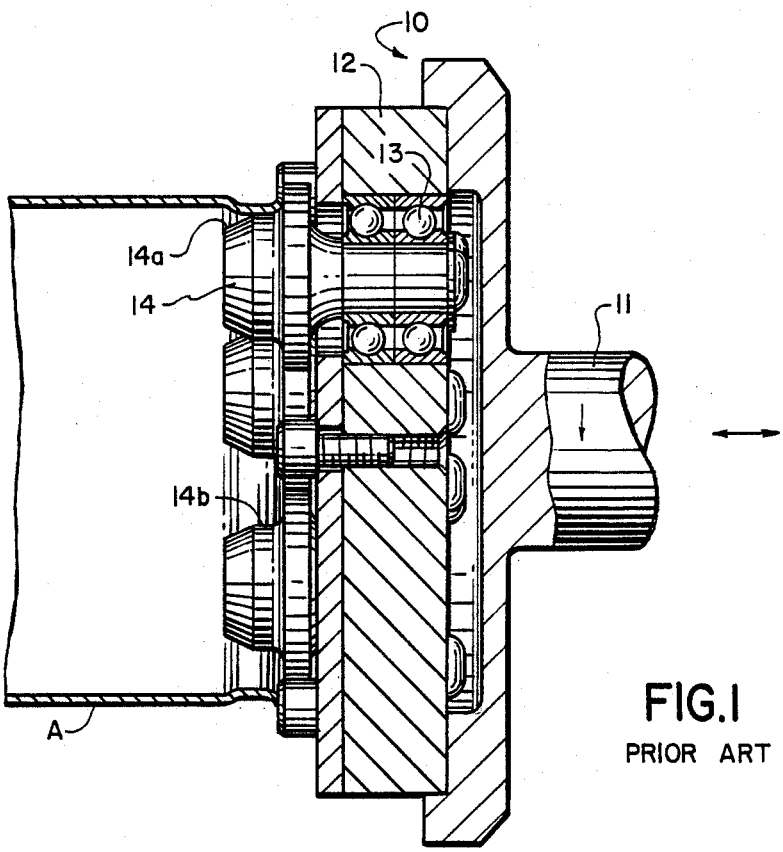
FIG.1
PRIOR ART
FIG.2
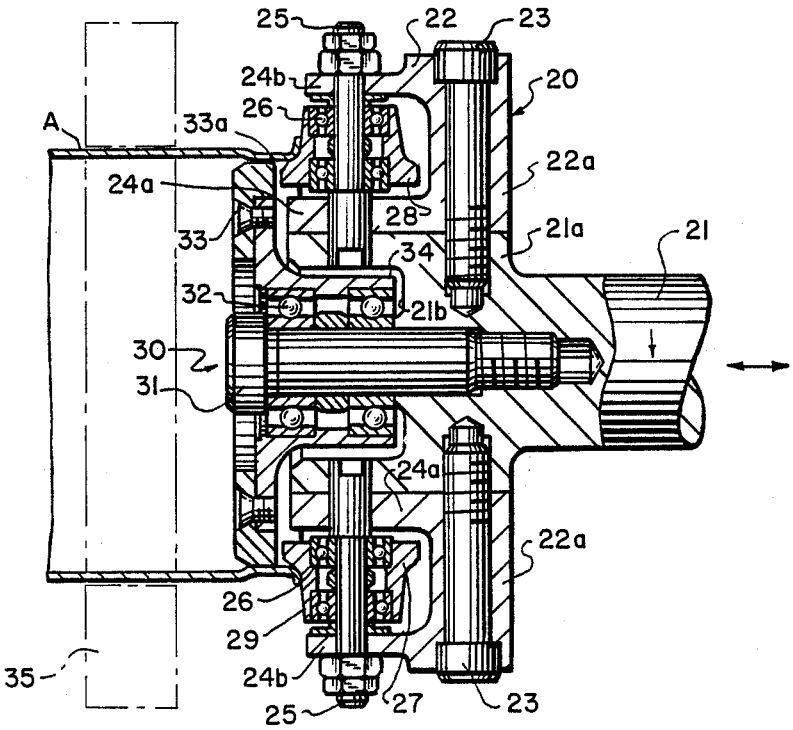

INCLINED AXES SPIN FLANGING HEAD AND METHOD FOR USING SAME

CROSS-REFERENCE TO RELATED APPLICATION

This application is a continuation-in-part of copending application Ser. No. 231,841, Filed Feb. 5, 1981 and now abandoned.

BACKGROUND OF THE INVENTION

This invention relates to forming flanges on a drawn and ironed (D&I) container, and in particular, to the so-called two piece beverage can and the tool used for putting a flange on the partially formed container. D&I refers to the process used to manufacture the container. A shallow metal cup is drawn from a thin metal sheet and then punched through a plurality of ironing rings which thin the wall without substantially reducing the diameter. During this process the wall of the container is reduced to about one third of its original thickness, thus leaving a cylindrical container open at one end with a thinner wall than the bottom. The open end is trimmed to be the right length and to be square with respect to the axis of the container. It is at this stage that the container is first necked then flanged, so that the container can be double seamed with an end during a closure process after filling.

D&I containers are generally made out of aluminum or tinplated steel; during the ironing process the metal is substantially worked, particularly in the sidewall, and thus the hardness of the material increases and its ductility decreases. Consequently, there is a potential for the metal to be overworked, to the point of failure. One mode of failure is the cracking of the outer periphery of the flange. More particularly, a radial crack occurs in areas of the flange where the metal has an inclusion or a weak point.

For many years containers have been drawn and ironed from low temper ($T_1$ and $T_2$) box annealed tinplate steel. This metal has operated successfully in providing the required combination of strength, hardness and ductility such that flange cracked cans could easily be kept below a predetermined number per thousand. It has been found to be desirable to use higher temper metals to manufacture D&1 containers. These higher temper materials can be used in lighter gauges, such that the number of containers which can be made per pound of steel are greater, and yet the performance and strength of the container so produced is equivalent to or better than the heavier gauge cans.

In experimenting with higher temper materials of light gauge, it has been found that the D&I process can be applied without much difficulty, except in the area of flange cracking. Techniques for overcoming the flange cracking problem include re-annealing before flanging, flanging to a shorter flange length or angle, and the like. All of these approaches have their disadvantages and limitations.

The present method of flanging uses a commercial flanging head having cones carried to rotate about their axes parallel to the axis of rotation of the total head. The tool is carried on a necker flanger machine, and is brought into the open end of the trimmed D&I container. The cones are rolled and moved against the upper inside edge of the container in such a way that the flange is flared outwardly to give the necessary configuration for an effective double seam. Use of this type of commercially available flanging head has produced about three times as many cracked flanges per thousand containers with higher temper materials as with the low temper steels or the softer aluminums.

OBJECTS OF THE INVENTION

It is, therefore, an object of the present invention to provide a spin flanging head, a system incorporating the head, and a method for using it, which enable a high temper metal of thin gauge to be employed for forming flanged containers, while minimizing the amount of flange cracking incurred.

It is also an object of the present invention to teach the construction of a flanging head which is capable of forming high-temper, light-gauge D&I containers on high speed commercial equipment.

It is another object of the present invention to refine the parameters of a new flanging head, such that the number of cracked flanges per thousand cans spin flanged are at a minimum.

A further object of the invention is to provide a spin flanging head, system and method by which a uniform flange can be produced on a metal container body, which is not rippled or fluted.

SUMMARY OF THE DISCLOSURE

Consistent with the foregoing objects, and in order to overcome the problems of the prior art, a new approach to a commercial flanging head for D&I containers is disclosed, and its operation is explained. In a periodical called *Tooling and Production,* dated October 1978, two researchers from the U.S. Steel Corporation disclose their experimental inclined axes flanging head. The improvements of the present disclosure are adapted to that device and, more specifically are included to make that device operate in a commercial environment. That is to say, that the improvements herein were necessary in order to make that experimental device suitable for high speed commercial operation on a necking and flanging machine. The U.S. Steel device includes a head having six rollers disposed radially about the head and each being mounted for rotation about an axis normal to that of the head. The spin flanging device proposed by U.S. Steel Corporation, when used in a commercial necker flanger, caused the end of the container to crush, producing a rippled or fluted flange which would be totally unacceptable for use in a doubleseam with an end closure.

Three specific improvements were necessary in order to produce an acceptable flange and minimize the number of cracked flanges per thousand. A piloting device was added to the drive axis of the inclined axes spin flanging head, which aids in forming a more uniform flange.

The roller configuration disclosed in connection with the experimental U.S. Steel Corporation head included a large diameter rim section with a smaller central hub. It has been found that angles of 110° to 150° and preferably 12O° for the inclination between the hub and rim are required in order to keep the rollers from interferring with the neck of the can. The radius between the hub and rim should be from about 0.070 to 0.090 inch.

A third modification necessary to adapt and use an inclined axes spin flange head with a commercial necker flanger relates to the way in which the flanging head is used. Commercial necker flangers include a camming device which moves the flanging head or the container axially to give contact with the flanging rollers. Any acceleration during the critical contact portion of the spin flanging operation will cause the flange to crush, developing a rippled or fluted surface. In accordance with the present invention, the camming device causes the flanging rollers to contact the can during a constant velocity portion of the cam profile.

It is known that the inclined axes spin flanging head of the present disclosure minimizes residual stress in the flange by providing gentler, smoother and more constant flange forming operation, such that harder temper materials can be used in lighter gauges for fabricating D&I cans.

DESCRIPTION OF THE DRAWINGS

FIG. 1 is a side cross-sectional view of the prior art commercial spin flanging head.

FIG. 2 is a side cross-sectional view of the inclined axes spin flanging head of the present disclosure.

DETAILED DESCRIPTION OF THE DRAWINGS

Figure 3:
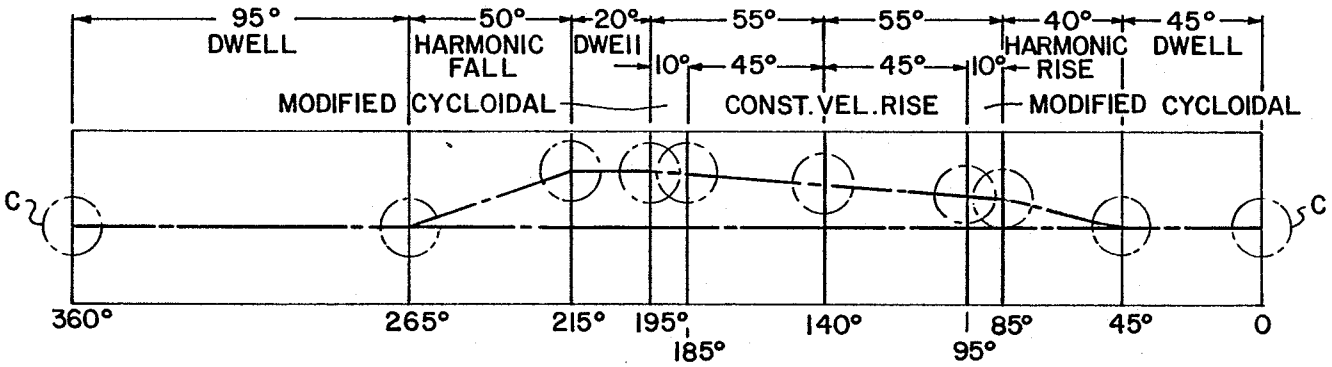
FIG. 3 is a schematic representation of the camming profile by which the flanging head is moved with respect to the container.

As background for the complete understanding of the invention, a brief description of the machine in which it is used will be included. American Can Company, the assignee of the present invention, manufactures and sells a Model 201-862 necker flanger machine. The purpose of the machine is to take the pretrimmed two-piece D&I container and first neck the upper end of the container inwardly, and then bend the flange outwardly for doubleseaming. Necking is necessary for several reasons, one of which is to keep the outside diameter of the doubleseamed container uniform so that the container can easily roll through equipment. By necking the container, the overall diameter of the doubleseamed end is identical to or less than that of the body. In certain instances it is even useful to double neck the open end of the container, such that an end of smaller diameter can be applied. This helps in lowering the cost in that the amount of material necessary for the end is reduced. Another aspect of necking of a container, which relates somewhat to flange cracking, is the ability to limit the radial extent of the distal portion of the flange so that the circumferential stresses in the metal about the periphery of the flange are kept to a minimum.

The machine for necking and flanging carries the container on its side by use of a series of turrets which are mounted on a horizontal axis. Each turret carries the containers in position such that there is relative axial movement permitted between the tools and the containers, which operate to perform necking or flanging functions. For aluminum cans, the steps of the operation are necking and then flanging. For the harder steel cans the machine first prenecks them on a first turret, necks on a second turret and finally flanges on the last turret.

As is evident by the foregoing, the harder the metal the more susceptible the container flange is to cracking. In the preferred embodiment, material such as T-4 temper continuously annealed tinplated steel is used. This material is much harder and stronger than that heretofore used. For example, the T-1 containers were made from a 103# plate. This terminology is standard in the can-making industry, and refers to the amount of steel in a base box of tinplate, a base box being a package of 112 sheets of steel 14 inches by 20 inches, or 31,360 square inches of area on one side. Since steel is sold by the pound, the base box convention is a shorthand means by which the weight of the material used is designated. By going to the harder T-4 temper material, tinplate of 95# per base box weight can be used to make containers of equal to or greater strength than those fashioned from T-1 103# plate. The impact of this gauge reduction with the same size blank is best appreciated with respect to an understanding that the T-4, 95# tinplate steel allows the manufacture of one extra container per pound of steel, or roughly 95 additional containers per base box: 85# steel of the same kind has also been used successfully. This of course implies that the extra hardness and reduction in ductility does not add additional cracked flanges, which would cause the additional containers to have to be scrapped.

The improved flanging head of the present disclosure has been found, in a commercial environment, to produce the lighter gauge, higher temper containers with no more than the standard number of cracked flanges per thousand containers, the number obtained with the standard T-1, 103# plate.

Turning now to FIG. 1, therein shown is a cross-sectional view of the prior art flanging head 10 carried on a necking flange machine (not shown) by a holder 11, which rotates and moves axially in and out in accordance with a cam (also not shown). The holder 11 carries a plate-like support or cone holder 12, designed to support a plurality of ball bearings 13 for each of the cones 14 such that they may rotate about axes parallel to that of the holder 11 on the ball bearings 13. Each cone 14 has a chamferred lead area **14*a* and a necked-in support shoulder 14*b* whereby the container A is flanged when the cone 14 meets with the necked-in container A due to the axial movement of the flange head 10, the spinning motion of the cone holder 12 and the rotating motion of the individual cones 14. There are four or five of such cones 14, depending on the inside diameter of the can, arranged (in FIG. 1 only three are shown) so that the container A is formed during the operation which moves the spin flanging head 10 axially into the open end of the necked container A. The parallelism between the axes of the cones 14 and the holder 11** is apparent from the description and FIG. 1.

Figure 4:
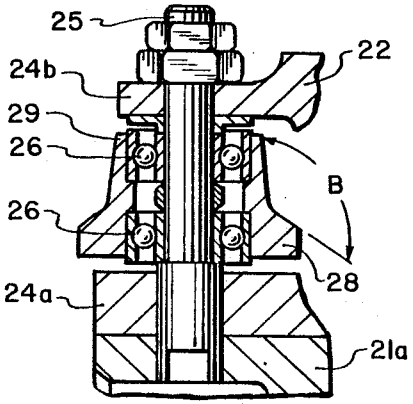
FIG. 4 is a fragmentary cross-sectional view of the head shown in FIG. 2, drawn to an enlarged scale.

In FIG. 2, the inclined axes spin flanging head 20 of the invention is shown. The head 20 includes a holder 21 including hub portion **21*a* designed for mounting a yoke 22 by means of bolts 23, which extend through the light portion 22*a* of the yoke 22 and into the hub 21*a* of the holder 21. The yoke 22 has a pair of inner and outer legs, 24*a* and 24*b* respectively, which are spaced apart and carry a stud 25, which is mounted to be radially disposed with respect to the hub 21*a*, preferrably at a 90° angle to the axis of holder 21. Stud 25 supports a pair of axially spaced apart roller bearings 26, carried inside a roller 27 for rotatably supporting the roller 27 relative to the stud 25 between the legs 24*a* and 24*b* of yoke 22; see FIG. 4 as well. As will be appreciated, because of this arrangement the roller and/or bearings can readily be replaced without taking the head off the machine, simply by removing the bolt 23** to release the entire yoke assembly.

There is a plurality of such rollers 27 radially disposed about hub 21a such that they function to engage a container brought axially to bear against them. Each roller 27 of the six rollers 27 on the preferred embodiment has a rim portion 28 and a hub portion 29. The angle B between the surfaces of the rim 28 and the hub 29 is critical to the performance of the roller 27. This angle should be greater than 110° and less than 150°, preferably about 120°. The radius between the intersection of the surfaces of the hub 29 and the rim 28 should be between 0.070" and 0.090".

In the center of hub 21a is a hollow recessed portion 21b designed to receive a pilot 30 axially disposed to rotate freely with respect to the inclined axis spin flanging head 20. The pilot 30 is secured axially by a shouldered mounting bolt 31, which carries a pair of spaced apart ball bearings 32 that support a flanged pilot 33. Pilot 33 includes a central outwardly extending mounting portion 34 adapted to cooperate with the bearings 32 and to fit within and be received by recess 21b, such that portion 34 is capable of rotating about the same axis as that about which the inclined axes spin flanging head 20 rotates. The outer radial or circumferential edge periphery 33a, of the flange portion of pilot 33 is shaped to receive the inside diameter across the necked-in portion with a total clearance (i.e., the differential between the diameters of the container portion and the pilot) of 0.010"; however, the clearance may be 0.010" per side.

Figure 5:
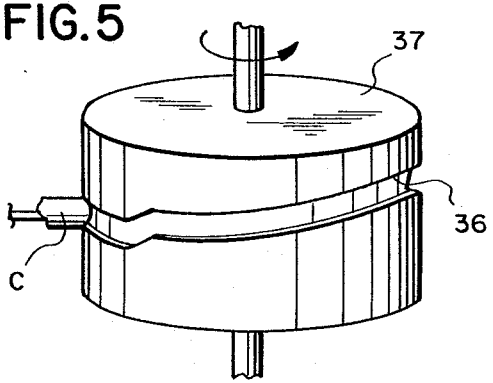
FIG. 5 is a schematic perspective representation of a circular disc-like cam and cam follower of the kind that may be used to effect movement of the head during flanging operations.

FIG. 3 is a schematic representation of the cam path used in connection with the movement of the inclined axis spin flanging head 20 of FIG. 2 into the container A. At each end of the schematic diagram the cam follower C is shown in phantom in its retracted position. The cam is a groove 36 cut into the edge of a circular disc 37, as shown in FIG. 5, which groove has varying axial positions such that it can activate a follower to move the inclined spin flanging head 20 of FIG. 2 to and from the container A. Going from the right in FIG. 3 to the left, we traverse the groove of the cam as the disc rotates through 360° while the follower moves in accordance with the path shown. More specifically, the movement of the rollers 27 to and from the container A is represented by the vertical movement of the phantomly shown follower C, and the rotation of the cam is linearly set out from right to left on the camming time diagram, FIG. 3. At the top of the schematic drawing, the individual segments of the cam action are specified in degrees for each segment; at the bottom the total degrees of rotation travelled from zero to 360° are specified. From zero to 45° of rotation, starting from the right and going to the left, we have a period of dwell wherein the inclined axes spin flanging head 20 is retracted and held apart from the container A, which is supported by a turret, a portion 35 of which is shown in phantom line in FIG. 2. From 45° to 85° there is a harmonic rise on the cam such that spin flanging head 20 is brought quickly into position for contact with container A. From 85° to 95° there is a modified cycloidal motion which is substantially constant in velocity but is designed to bring the head 20, i.e., rollers 27, into contact or engagement with the container A, as shown in FIG. 2, to begin the flanging operation. For the following 100° there is a continual constant velocity increase in movement such that the rollers 27 are, throughout the entire 110° of rotation (from 85° to 195°), moved about 0.0078" per degree of cam rotation toward the container A. As shown in FIG. 2, the flange of the container is, of course, being formed during this phase, the last 10° of which, from 185° to 195°, is modified cycloidal in nature. For the next 20°, i.e., from 195° to 215°, the lifted position of the follower C is in a dwell state such that the rollers 27 are held against the now outwardly formed flange of container A. This 20° of dwell is necessary in order to set the flange and overcome any tendency to spring back. It takes 50° more, from 215° to 265° of rotation, for the cam follower C to retract the head 20 or cause the same to fall away from the container A, and this motion is harmonic in order to speed the retraction. The rest of the rotation of the cam or 95° is for dwell and extends to the initial 45° of dwell. Without constant velocity during the flange spinning operation a fluted or rippled flange will be generated.

As can be seen in FIG. 2, during the flanging operation the container body A is supported by the turret 35 so that, as the head is moved into the container, the outer cylindrical element or circumferential edge 33a, of the radial periphery of the pilot is closely disposed adjacent to, but with annular clearance from, the inside surface of the necked-in portion. Because of the thinness of the material, a wave effect is set up by the action of the rollers in flaring the metal and forming the flange. The underlying surface of the pilot periphery controls such movement by limiting the inward deflection of the metal, and thereby prevents the wrinkling or rippling of the flange that would otherwise tend to occur, as would render the container unusable.

While a specific high temper material of a given plate weight and material has been described in connection with the preferred embodiment, and while a particular American Can Company necker flanger has been explained in connection with the inclined axes spin flanging head 20, the invention in its broadest context is to the specific areas of improvement added to inclined axes spin flanging heads. It is desired that the claims which follow cover any design or use for such a head which includes the novel and unique improvements herein disclosed.

Having thus described the invention, what is claimed is:

1. In a method for spin flanging the open end of a cylindrical metal container the steps including:

(a) providing an inclined axis spin flanging head, said head comprising a body having a forward end and being adapted for rotation about an axis thereof, a plurality of forming rollers supported on said body at locations spaced about said body axis, and a pilot member mounted on said body for free rotation on said axis thereof, said rollers being of generally conical form, each having axially spaced opposite ends, and being mounted for free axial rotation about axes extending generally radially to said body axis, the exterior surfaces of said rollers being configured to cooperatively produce a flare in the end of a cylinder forced thereagainst, in the axial direction of said body, by reforming the material thereof, said pilot member having a circular portion disposed forwardly and coaxially on said body with its outermost circumferential edge directly in front of said rollers, the axial projection of said circumferential edge intersecting each of said rollers at a point intermediate said ends thereof;

(b) supporting said head for rotation about said body axis, and for axial reciprocation;

(c) supporting a hollow, thin-wall cylindrical metal container adjacent said head and forwardy thereof, said container having an open end and being coaxially aligned on said body axis with said open end facing said head;

(d) rotating said head; and (e) moving said rotating head axially to move said pilot member into said open end of said container and to cause the edge of said container surrounding said open end to contact said roller surfaces, and from the point of initial contact thereafter continuing such inward movement of said rotating head at constant velocity to effect a flaring deformation of an end portion of said container extending inwardly from said surrounding edge, said circumferential edge of said circular portion of said pilot member being of smaller diameter than said end portion, so as to provide a surface disposed closely adjacent thereto but normally with annular clearance therebetween, as said end portion is passed over said pilot member circular portion, the action of said rollers in deforming said end portion tending to induce a wave effect in said metal, and said surface of said pilot member being disposed to limit inward deflection of said metal, and thereby to prevent the wrinkling or rippling thereof that would otherwise tend to occur.

2. The method of claim 1 wherein each of said rollers is comprised of a conic rim section and a radially outward conic hub section joined by a section that is arcuate in axial cross section, the surfaces of said conic sections being disposed at an angle of about 120° to one another and said arcuate section having a radius of curvature of about 0.070 to 0.090 inch; and wherein said circumferential edge of said pilot member circular portion is of cylindrical configuration.

3. The method of claim 2 wherein, in said step (e), initial contact of said surrounding edge of said container with each of said rollers occurs in the area of said rim section near said arcuate section thereof, said continued movement causing said surrounding edge to thereafter pass over said arcuate section and said hub section surfaces.

4. The method of claim 1 wherein said container is made of T-4 temper continuously annealed tinplated steel of about 95 pound per basebox weight.

5. In a system for forming flanges on the open ends of cylindrical metal containers, the combination comprising:

(a) an inclined axis spin flanging head, comprised of: a body having a forward end and being adapted for rotation about an axis thereof; a plurality of forming rollers supported on said body at locations spaced about said body axis; and a pilot member mounted on said body for free rotation on said axis thereof, each of said rollers comprising a conic rim section and a conic hub section joined by a section that is arcuate in axial cross section, having axially spaced opposite ends, and being mounted for free axial rotation about axes extending generally radially to said body axis and in a common plane, the hub sections of said rollers being of smaller cross section than said rim sections thereof and said rollers being disposed on said body to taper in radial outward directions to enable the exterior surfaces thereof to cooperatively produce a flare in a cylinder forced thereagainst, in the axial direction of said body, by reforming the material thereof, said pilot member having a circular portion disposed forward and coaxially on said body with its outermost circumferential peripheral edge directly in front of said rollers, the axial projection of said circumferential edge intersecting each of said rollers at a point intermediate said ends thereof;

(b) means for supporting said head for rotation about said body axis, and for axial reciprocation;

(c) means for supporting a hollow, thin-wall cylindrical metal container, having an open end, adjacent said head and forwardly thereof with its open end coaxially aligned on said body axis and facing said head;

(d) means for rotating said head; and (e) means for moving said head axially to move said pilot member into the open end of the container and to cause the edge of the container surrounding its open end to contact exterior surfaces of said rollers, and for thereafter continuing such inward movement of said head at constant velocity to effect such flaring deformation and flanging of an end portion of the container extending inwardly from said surrounding edge, said circumferential edge of said circular portion of said pilot member being of smaller diameter than said end portion, so as to provide a surface disposed closely adjacent thereto but normally with annular clearance therebetween, as said end portion is passed over said pilot member circular portion, the action of said rollers in deforming said end portion tending to induce a wave effect in said metal, and said surface of said pilot member being disposed to limit inward deflection of said metal, and thereby to prevent the wrinkling or rippling thereof that would otherwise tend to occur.

6. The system of claim 5 wherein said means for moving said head includes a cam and a follower, said cam having a profile that produces such constant velocity inward movement of said head.

7. The system of claim 6 wherein said cam profile imparts to said head sequential phases of movement including: (1) a period of dwell, with said head retracted; (2) a harmonic rise to position said head for contact with the cylinder edge; (3) substantially constant velocity modified cycloidal motion to effect contact of said rollers with the cylinder edge; (4) said continuing inward movement of said head at constant velocity for flanging; (5) a period of dwell with said rollers held against the flange produced in the cylinder; and (6) retraction of said head, said velocity in said phases (3) and (4) being the same.

8. The system of claim 7 wherein said cam is circular, and wherein said phases occur at the following stages of angular displacement from a starting point: (1) zero to 45°; (2) 45° to 85°; (3) 85° to 95°; (4) 95° to 195°; (5) 195° to 215°; and (6) 215° to 265°.

9. The system of claim 8 wherein motion in the last 10° of said phase (4) is of modified cycloidal nature.

* * * * *